US006059490A

United States Patent [19]

Kauppi

[11] Patent Number: 6,059,490

[45] Date of Patent: May 9, 2000

[54] HYDRAULIC ENERGY DISSIPATING OFFSET STEPPED SPILLWAY AND METHODS OF CONSTRUCTING AND USING THE SAME

[76] Inventor: Frederick J. Kauppi, 3604½ Park La., Newport Beach, Calif. 92663

[21] Appl. No.: 09/072,836

[22] Filed: May 5, 1998

[51] Int. Cl.[7] ..... E02B 7/08; E02B 8/06

[52] U.S. Cl. ..... 405/108; 405/114

[58] Field of Search ..... 405/16, 17, 21, 405/33, 108, 114

[56] References Cited

U.S. PATENT DOCUMENTS

| | | | |
|---|---|---|---|
| 1,561,796 | 3/1925 | Rehbock | 405/108 |
| 3,176,468 | 4/1965 | Nagai et al. | 405/29 |
| 3,614,866 | 10/1971 | Kaneko et al. | 405/29 |
| 3,759,043 | 9/1973 | Tokunaga | 249/102 |
| 3,995,434 | 12/1976 | Kato et al. | 405/33 |
| 4,269,537 | 5/1981 | O'Neill | 405/29 |
| 4,503,649 | 3/1985 | Sciortino | 405/16 |
| 4,661,014 | 4/1987 | Aubert | 405/111 |
| 4,856,935 | 8/1989 | Haras | 405/35 |
| 4,978,247 | 12/1990 | Lenson | 405/15 |
| 5,087,150 | 2/1992 | McCreary | 405/31 |
| 5,122,015 | 6/1992 | Shen | 405/284 |
| 5,190,403 | 3/1993 | Atkinson | 405/29 |
| 5,544,973 | 8/1996 | Frizell et al. | 406/16 |
| 5,702,208 | 12/1997 | Hilfiker et al. | 405/258 |
| 5,779,391 | 7/1998 | Knight | 405/20 |
| 5,803,660 | 9/1998 | Warren et al. | 405/25 |
| 5,906,456 | 5/1999 | Knight | 405/20 |
| 5,921,710 | 7/1999 | Scales | 405/20 |

OTHER PUBLICATIONS

"Background of History" of 9 pages. "Following are some excerpts from Energydissipators by D.L. Visher and W.H. Hager . . . " 1995.

"BackgroundHydraulicSupplement" of 2 pages, (date unknown).

"Flow and Energy Dissipation Over Stepped Gabion Weirs" by L. Peyras, P. Royet, and G. Degoutte of 6 pages, (1990).

"OverTheTop Concrete" CivilEngineering/Jan. 1998, pp. 72–75.

"Design of Rock Chutes" (Paper No. 972062) by K.M. Robinson, C.E. Rice and K.C. Kadavy of 16 pages, (Aug. 1997).

"Rock Chutes For Grade Control" by K.M. Robinson, C.E. Rice and K.C. Kadavy of 6 pages, (1997).

"Stepped SpillwayHydraulicModel Investigation" by Robert M. Sorensen of 8 pages, (1984).

"SkimmingFlow In Stepped Spillways" by G. Degoutte, L. Peyras and P. Royet, of 3 pages, (1990).

"EnergyDissipationOn Stepped Spillways" by G.C. Christodoulou, of 4 pages, (1992).

"SkimmingFlow In Stepped Spillways" by N. Rajaratnam, of 3 pages, (1988).

(List continued on next page.)

*Primary Examiner*—Eileen Dunn Lillis
*Assistant Examiner*—Tara L. Mayo
*Attorney, Agent, or Firm*—Stetina Brunda Garred & Brucker

[57] ABSTRACT

A spillway for use in a sloped embankment which defines a top and a toe. The spillway is adapted to dissipate the kinetic energy of water flowing downwardly from the top of the embankment to the toe thereof in a primary flow direction. The spillway comprises a plurality of building blocks arranged in rows which are stacked upon each other in a shingle-like overlap such that the building blocks of each row are offset relative to the building blocks of each adjacent row and a series of steps are defined thereby. The building blocks are sized and configured such that water cascading down the steps defined thereby is caused to flow in three dimensions so as to impart velocity components to the falling water that act at generally right angles relative to the primary flow direction and generate turbulence which dissipates the kinetic energy of the water.

30 Claims, 5 Drawing Sheets

OTHER PUBLICATIONS

"Jet Flow On Stepped Spillways" by Hubert Chanson (May 1995), of 8 pages.

"Jet Flow On Stepped Spillways" by M.R. Chamani and N. Rajaratnam, of 3 pages, (date unknown).

"HydraulicsOf SkimmingFlows Over Stepped ChannelsAnd Spillways" by Hubert Chanson, of 16 pages, (1994).

"EnergyDissipators" by A.A. Balkema, Rotterdam & Brookfield (1995), of 22 pages.

Fig. 11
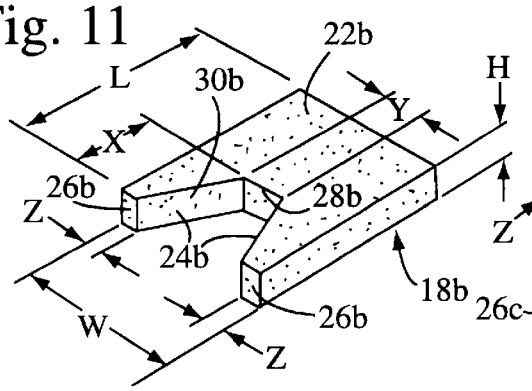
Fig. 12
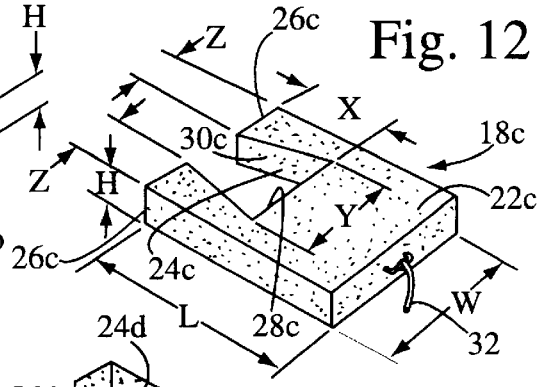
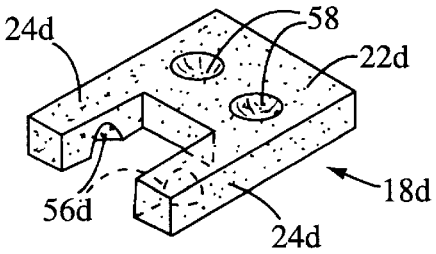
Fig. 13
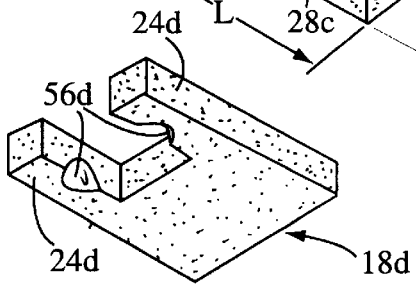
Fig. 14
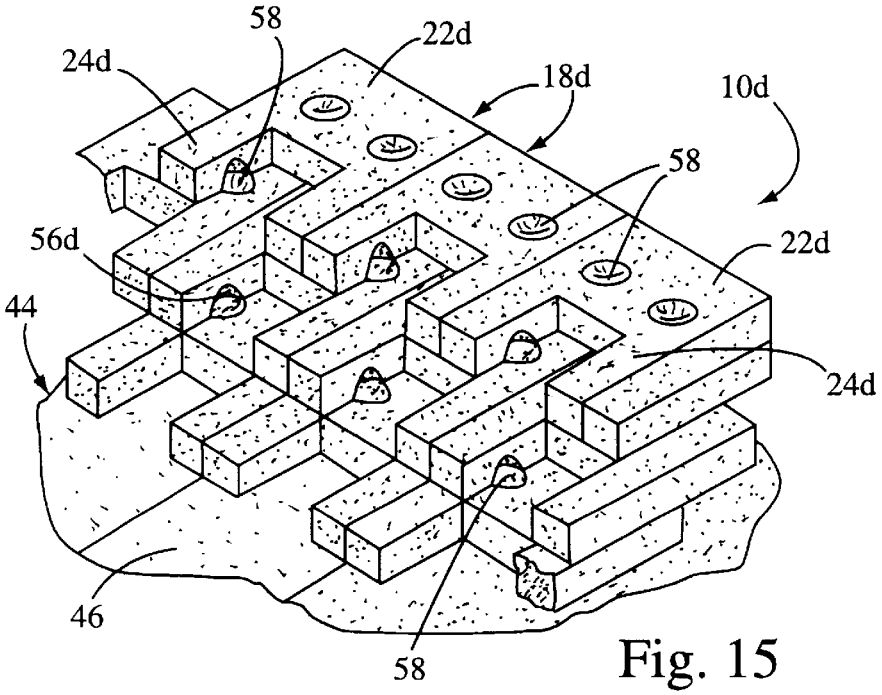
Fig. 15

HYDRAULIC ENERGY DISSIPATING OFFSET STEPPED SPILLWAY AND METHODS OF CONSTRUCTING AND USING THE SAME

FIELD OF THE INVENTION

The present invention relates generally to devices used for the dissipation of hydraulic or kinetic energy, and more particularly to a spillway structure constructed from a plurality of pre-formed building blocks which are specifically shaped, dimensioned and arranged so as to induce the maximum amount of turbulence in water flowing thereover, thus minimizing the amount of kinetic energy in the water mass as it drops to the toe of the spillway.

BACKGROUND OF THE INVENTION

As is well known in the field of hydraulic engineering, there is an ongoing need to inhibit erosion caused by rivers, streams and other waterways both natural and man made which occurs at locations where there is a change in grade. Well known in the prior art are various types of hydraulic energy dissipation devices which are commonly referred to under the collective term "energy dissipators", and are used to provide erosion control protection by serving as, among other things, dam spillways, drop structures in natural streams or man made channels, and grade control structures in natural streams or man made channels. The significant resources devoted by many governmental agencies to protect civil structures such as canals, dams or other waterways constructed of earthen materials from erosion has resulted in the development of a relatively wide range of prior art energy dissipators and other erosion protection systems.

One category of prior art energy dissipator is adapted to develop a high velocity at the toe or bottom of the drop, with dissipation of the hydraulic or kinetic energy being accomplished by a hydraulic jump. These types of energy dissipators typically shorten the length of the hydraulic jump and subsequently reduce the distance of high velocities downstream of the toe which would otherwise cause scour. In the prior art, there are numerous designs of these types of energy dissipators currently in use, with perhaps the most common being a stilling basin which incorporates special appurtenances (i.e., chute block, end sills, baffles, etc.) which tend to stabilize the hydraulic jump and improve its performance.

Other types of prior art energy dissipators currently under research include stepped spillways, roller compacted concrete (RCC), gabions, riprap, baffle apron drops, geotextiles, and concrete block revetment systems. However, as will be discussed below, these prior art energy dissipators each possess certain deficiencies which detract from there overall utility.

Gabions are wire baskets which are filled with rock and anchored to slopes for erosion protection. Though gabions have been successfully used for building dams with gabion spillway weirs, research has indicated that though they may perform well if anchored properly, they undergo considerable deformation under certain flow conditions. More particularly, it has been determined that structural deformation of gabions could occur for flows in excess of sixteen (16) CFS or velocities between fifteen (15) and seventeen (17) feet per second. For flows in excess of these parameters, additional strengthening is typically required for the gabions.

With regard to riprap, research is currently underway regarding the use of riprap as a means of reducing toe velocities using rock chutes. Thus far, this research has indicated that there are limiting factors associated with the structural stability of riprap on steep slopes subject to high flows which severely limits its utility. In particular, modeling has demonstrated that riprap scaled to represent a median twenty-four (24) inch diameter rock on a 3 to 1 slope was only able to withstand a scaled unit discharge of under twenty three (23) CFS per foot. Flows in excess of this value exhibited failure by materials being dislodged and transported down the slope (chute). At present, the difficulties associated with accurately predicting the behavior of riprap protection has mitigated against its recommended usage as protection from overtopping flows of any significant magnitude.

Though roller compacted concrete (RCC) has proven to be very effective in protecting against erosion, the protection imparted thereby is attributable to the thickness of the concrete overlay alone. Though the applications for roller compacted concrete are widespread, they rely on the strength of the material and the cover thickness to provide erosion protection. It has been determined that subjecting the materials to high velocity flow would likely degrade the protective system. Additionally, the installation techniques associated with roller compacted concrete are generally economical only for the placement of large qualities of material, and further require easy site access. Moreover, roller compacted concrete may significantly impact the surrounding environment.

Though baffle apron drops have been used successfully in canal design, the systems have not had extensive use in flood control applications and are susceptible to damage from debris. Additionally, testing of geotextiles has indicated that failure occurs at relatively high velocities, with such failure believed to be caused by poor anchoring or stretching of the material.

Concrete block revetment systems (articulating blocks) are generally cable-tied together and anchored to the embankment, with grass being used to cover over the voids. However, the use of concrete block revetment systems is largely limited to erosion protection, with most of these systems being designed to prevent river bank erosion. Thus far, two such systems have been tested and are in limited use for overtopping protection, but are considered to be unsuitable for high flow velocities due to the energy dissipation properties being minimal.

Step spillways have been in use for thousands of years, and are currently experiencing a re-emergence. In this respect, the step spillway is currently under strong research, with many hydraulic researchers believing that step spillways will be included with the more classical types of energy dissipators currently being used in erosion protection applications. The stepped spillway is a simple form of a rough channel wherein a stable rolling vortex is developed within each step. This rough channel does not allow the velocity down the drop to reach the velocity that would occur on a smooth spillway, with these reduced toe velocities having an effect on the stilling basin design at the toe. The stable rolling vortex created within each step of the stepped spillway as discharge flows down the drop dissipates a considerable amount of hydraulic or kinetic energy. However, although dissipating energy, the vortex also acts as a "cushion" for skimming flows. This particular hydraulic characteristic results in little lateral movement of the water or discharge as it flows down the drop and velocities that are basically two dimensional.

The shortcomings of the above-described prior art energy dissipators are overcome by the offset stepped spillway constructed in accordance with the present invention which dissipates energy at rates exceeding several magnitudes above any known prior art energy dissipation system. In this respect, the offset stepped spillway of the present invention has the ability to dissipate large amounts of kinetic energy on a continuous basis, and possesses several hydraulic characteristics which represent a significant departure from those associated with prior art stepped spillways. In particular, the offset steps and stacking pattern in the present spillway annihilates any semblance of a stable vortex at each step, and creates high gradient velocity zones. Additionally, the offset steps and stacking pattern creates a high lateral diffusing of velocities, and thus transforms two dimensional flow into three dimensional flow. Moreover, the offset steps and stacking pattern is believed to generate slight vortex rollers, with the offset steps creating a shear zone where there is a negative (upslope) velocity component coming in contact with the primary positive (downslope) velocity component. This negative-positive contact is believed to occur on the drop and interferes with the primary direction of flow which reduces the velocity in the primary direction and thus dissipates additional kinetic energy.

SUMMARY OF THE INVENTION

In accordance with the present invention, there is provided a spillway for use in a sloped embankment which defines a top and a toe. The present spillway is adapted to dissipate the hydraulic or kinetic energy of water which flows downwardly from the top of the embankment to the toe thereof in a primary flow direction.

The spillway of the present invention comprises a plurality of building blocks which are arranged in rows, with each row including multiple building blocks disposed in side-by-side relation to each other. The rows of building blocks are stacked upon each other in a shingle-like overlap such that the building blocks of each row are laterally offset or staggered relative to the building blocks of each adjacent row and a series of steps are defined thereby. The building blocks are dimensioned and shaped such that water cascading down the steps defined thereby is caused to flow in three dimensions. Such three-dimensional flow imparts velocity components to the falling water that act at generally right angles relative to the primary flow direction and generate turbulence (i.e., create a churning action) which dissipates the kinetic energy of the water. Each of the building blocks is preferably fabricated from concrete, and includes a tether extending therefrom for anchoring the same to the embankment.

In addition to the building blocks, the present spillway further comprises at least one, and preferably multiple toe plates which extend along the toe of the embankment in side-by-side relation to each other. The lowermost row of building blocks are partially positioned upon and supported by the toe plate(s). The spillway also includes at least one crest plate which extends along the top of the embankment. The crest plate itself is partially positioned upon and supported by the uppermost row of building blocks. Like the building blocks themselves, the toe and crest plates are each preferably fabricated from concrete.

In the present spillway, the building blocks preferably comprise full blocks and half blocks. In this respect, the outermost building blocks of every other row in the spillway comprise half blocks, with the remaining building blocks comprising full blocks. The full blocks themselves each comprise a base portion having a pair of finger portions extending therefrom in spaced relation to each other. The base and finger portions of each full block collectively form a three-sided slot having a back wall which is defined by the base portion and opposed sidewalls which are defined by respective ones of the finger portions. In certain embodiments of the present invention, the slot has a generally rectangular configuration, while in other embodiments the slot has a generally trapezoidal configuration or a dovetail configuration. The half blocks each comprise one-half of a full block, and include a base portion having a finger portion extending therefrom. The base and finger portions of each half block collectively form a two-sided notch having a back wall which is defined by the base portion and a sidewall which is defined by the finger portion.

In the present spillway, the building blocks (i.e., the full and half blocks) are arranged such that the distal ends of each adjacent or abutting pair of finger portions in a particular row extend to the back wall of the slot of a respective full block in the row immediately therebelow. The distal end of each finger portion in a particular row not abutting another finger portion extends to the back wall of the notch of a respective half block in the row immediately therebelow. In accordance with an alternative embodiment of the present invention, the finger portions of the full and half blocks may each include a generally conical indentation or other shaped indentation formed therein to assist in the generation of turbulence within the falling water.

In another alternative embodiment of the present invention, the base portion of each full block may include a pair of generally conical indentations formed therein, with the finger portions each including a generally conical indentation formed therein. If configured in this manner, the full blocks are arranged in the spillway such that the indentations in the finger portions of each of the full blocks in a particular row align with one of the indentations of respective ones of an adjacent pair of the full blocks in the row immediately therebelow. Each pair of the aligned indentations effectively creates additional energy dissipation properties. The half blocks used in conjunction with these particular full blocks each comprise one-half of a full block, and thus each include a single conical indentation formed in the base portion thereof.

In the present spillway, the desired dissipation of kinetic energy in the falling water is achieved by sizing the full and half blocks relative to the slope S of the embankment and to each other in a specific manner. More particularly, each of the full blocks is preferably sized to have a width W which is the product of a constant C and its height H, with the finger portions thereof each preferably having a length X which is equal to the product of the slope S and height H. The constant C is preferably from about 3 to 5, and most preferably about 4. In each of the full blocks, the distal ends of the finger portions each have a preferred width Z. The depth of the slot in each full block is equal to the lengths X of the finger portions thereof. In certain embodiments of the present invention, the width Y of the back wall of the slot of each full block is about two times the width Z and, in one embodiment, is about one-half the width W. In another embodiment of the present invention, the width Y of the back wall of the slot of each full block is equal to the difference between the width W and two times the width Z.

Since, as indicated above, each half block is configured as one-half a full block, each of the half blocks is preferably sized to have a width W' which is about one-half the width W of each full block, with the back wall of the notch of each half block preferably having a width Y' which is about one-half the width Y of the back wall of the slot of each full block. Like each full block, each half block is of the height H, with the finger portion thereof being of the length X which is equal to the product of the slope S and height H. The distal end of the finger portion of each half block is also of the width Z.

Further in accordance with the present invention, there is provided a method for constructing a spillway usable in a sloped embankment defining a top and a toe and adapted to dissipate the kinetic energy of water flowing downwardly from the top of the embankment to the toe thereof in a primary flow direction. The method comprises the initial step of cutting a plurality of terraces into the embankment so as to define a series of steps which extend from the top to the toe. Thereafter, at least one toe plate is extended along the toe of the embankment. A plurality of pre-fabricated building blocks are then arranged upon the terraces in rows which are stacked upon each other in a shingle-like overlap. The arrangement is accomplished such that the building blocks of each row are offset relative to the building blocks of each adjacent row in a manner wherein water cascading down the building blocks is caused to flow in three dimensions so as to impart velocity components to the falling water that act at generally right angles relative to the primary flow direction and generate turbulence which dissipates the kinetic energy of the water. Additionally, the lowermost row of building blocks is partially positioned upon the toe plate, with each of the building blocks being anchored to the embankment through the use of a tether extending therefrom. Finally, a crest plate is partially positioned upon the uppermost row of building blocks.

The construction of the spillway may also proceed from the bottom of the embankment upward by backfilling against the building blocks to create the terrace effect. This process is repeated until the desired height of the spillway and embankment is obtained. Additionally, a spillway having the structural and functional attributes described above may be created through the use of field formed concrete which is cast in place rather than through the use of the building blocks.

Still further in accordance with the present invention, there is provided a method for dissipating the hydraulic or kinetic energy of falling water. The method comprises the steps of causing the water to flow forwardly along horizontally oriented primary flow direction axes, and causing the water to flow laterally along horizontally oriented secondary flow direction axes which extend at generally right angles relative to the horizontally oriented primary flow direction axes. The method comprises the further step of causing the water to flow downwardly along vertically oriented primary flow direction axes which extend at generally right angles relative to the horizontally oriented primary flow direction axes and the secondary flow direction axes. The steps of imparting three dimensional flow to the water are preferably accomplished through the use of a spillway comprising a plurality of building blocks arranged in rows which are stacked upon each other in a shingle-like overlap such that the building blocks of each row are offset relative to the building blocks of each adjacent row and a series of steps are defined thereby.

BRIEF DESCRIPTION OF THE DRAWINGS

These, as well as other features of the present invention, will become more apparent upon reference to the drawings wherein:

FIG. 11 is a front perspective view of a full building block of a third embodiment of the present invention;

FIG. 12 is a rear perspective view of a full building block of a fourth embodiment of the present invention;

FIG. 13 is a front, top perspective view of a full building block of a fifth embodiment of the present invention;

FIG. 14 is a front, bottom perspective view of the full building block shown in FIG. 13;

FIG. 15 is a front perspective view of a portion of an offset stepped spillway constructed using the building blocks of the fifth embodiment shown in FIGS. 13 and 14;

DETAILED DESCRIPTION OF THE PREFERRED EMBODIMENTS

Figure 1:
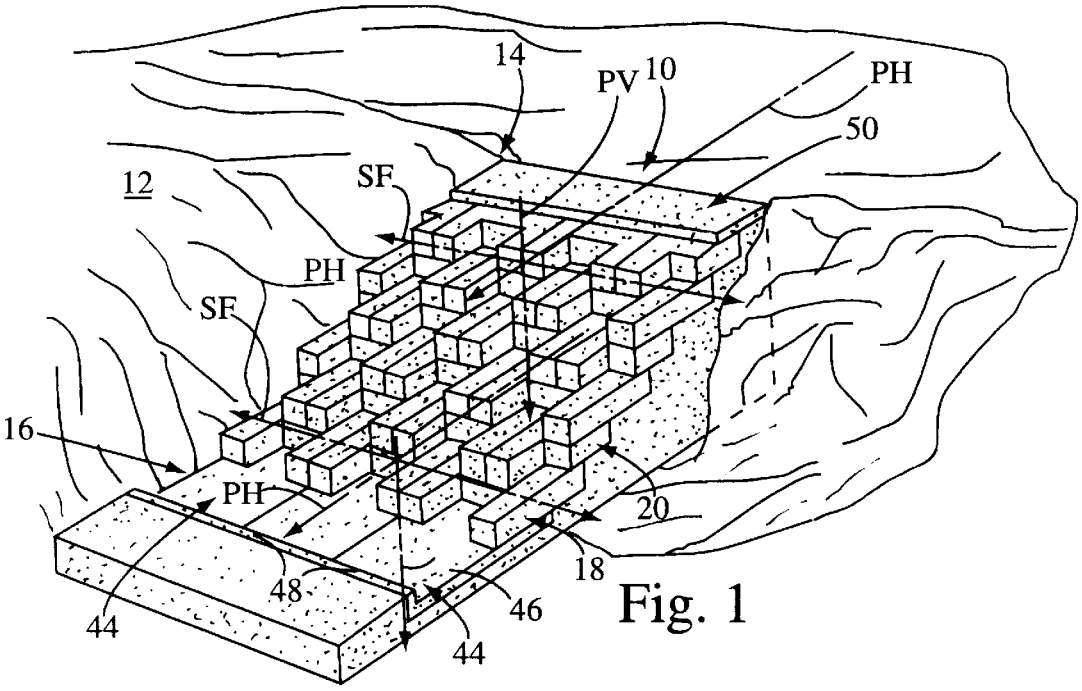
FIG. 1 is a perspective view of the offset stepped spillway constructed in accordance with the present invention.
Figure 8:
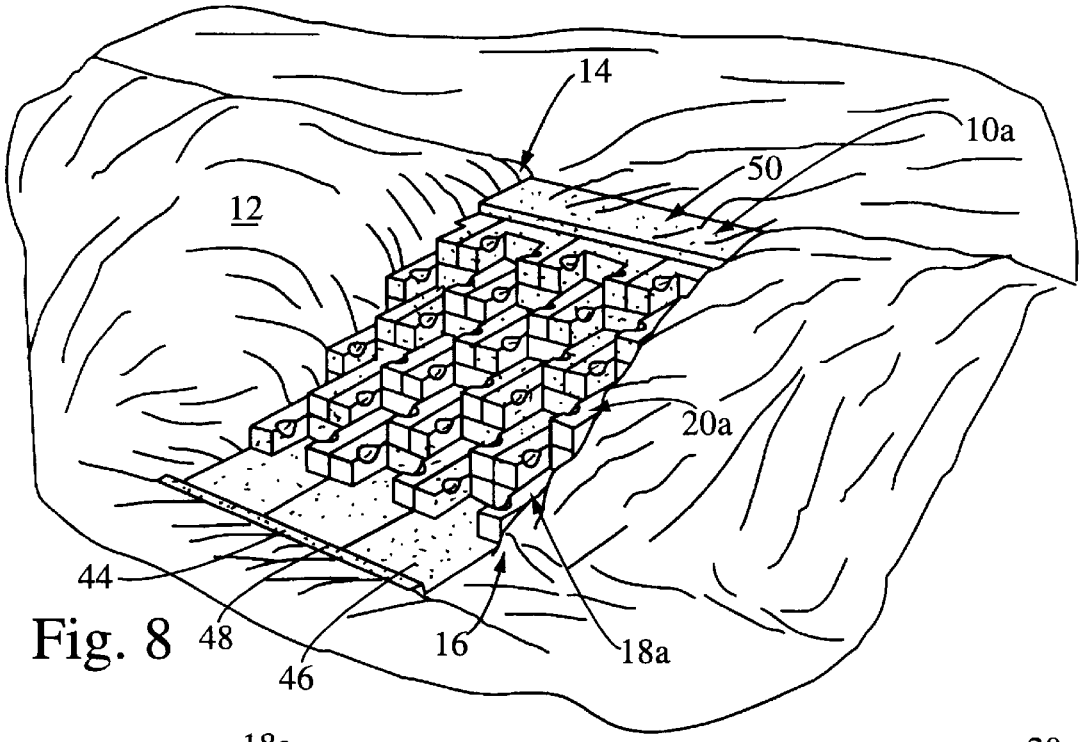
FIG. 8 is a perspective view similar to FIG. 1 illustrating an offset stepped spillway constructed in accordance with a second embodiment of the present invention.

Referring now to the drawings wherein the showings are for purposes of illustrating preferred embodiments of the present invention only, and not for purposes of limiting the same, FIG. 1 perspectively illustrates the offset stepped spillway 10 constructed in accordance with the present invention. The spillway 10 is specifically suited for use in a sloped embankment 12 which defines a top 14 and a toe 16 (as shown in FIG. 8). The embankment 12 has a slope S which governs the dimensions of the components used to construct the spillway 10, as will be discussed in more detail below. As will also be discussed below, the spillway 10 is adapted to dissipate the hydraulic or kinetic energy of water which flows downwardly from the top 14 of the embankment 12 to the toe 16 thereof in a primary flow direction. This primary flow direction is generally horizontal as exemplified by the axes PF shown in FIG. 1.

Referring now to FIGS. 1 and 3–5, the spillway 10 comprises a plurality of building blocks which are arranged in rows, with each row including multiple building blocks disposed in side-by-side relation to each other (i.e., in abutting contact). The rows of building blocks are stacked upon each other in a shingle-like overlap such that the building blocks of each row are laterally offset or staggered relative to the building blocks of each adjacent row and a series of steps are defined thereby which extend from the top 14 to the toe 16.

Figure 3:
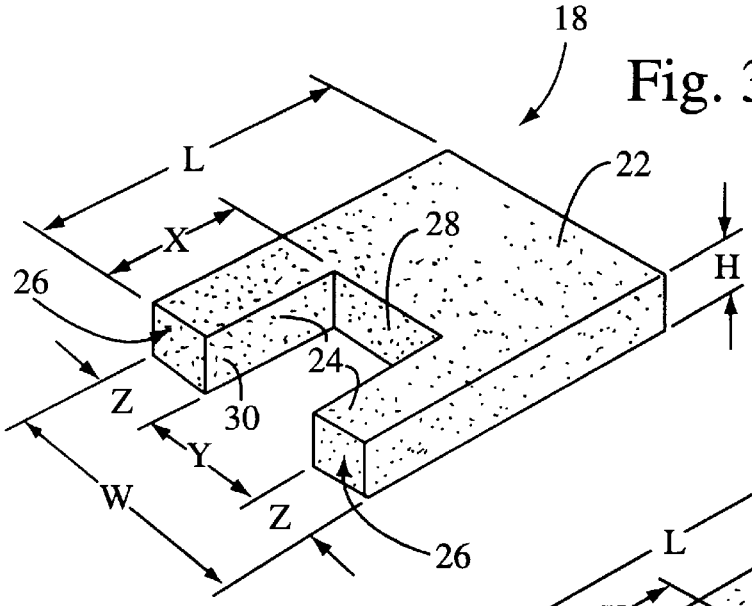
FIG. 3 is a front perspective view of a full building block of the offset stepped spillway shown in FIG. 1.
Figure 4:
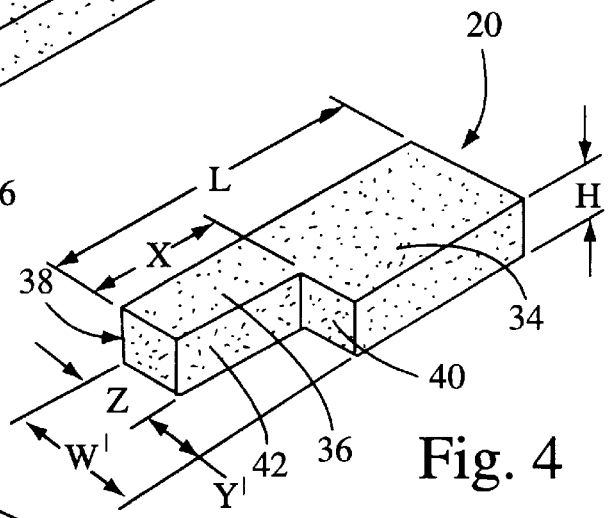
FIG. 4 is a front perspective view of a half building block of the offset stepped spillway shown in FIG. 1.
Figure 5:
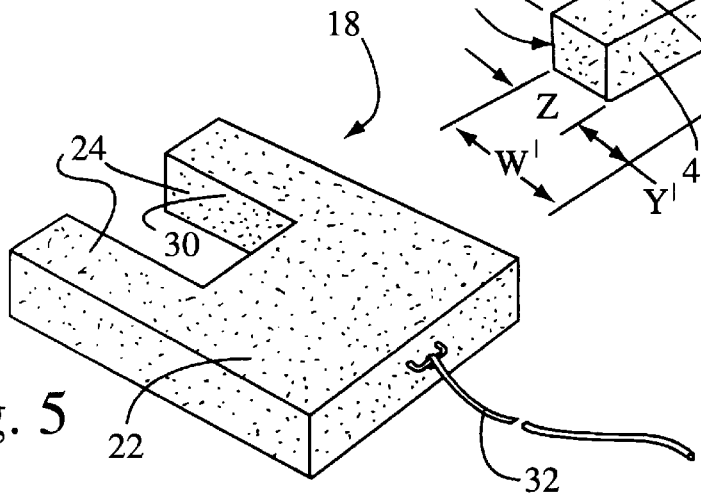
FIG. 5 is a rear perspective view of a full building block, illustrating a tether extending therefrom for anchoring the building block to an embankment.

More particularly, the building blocks of the spillway 10 preferably comprise generally U-shaped full blocks 18 (one of which is shown in FIG. 3) and half blocks 20 (one of which is shown in FIG. 4). As seen in FIG. 1, the outermost building blocks of every other row in the spillway 10 comprise half blocks 20, with the remaining building blocks comprising full blocks 18. The full blocks 18 each comprise a base portion 22. Extending from the base portion 22 in spaced, generally parallel relation to each other is an identically configured pair of finger portions 24, each of which defines a distal end 26. The base and finger portions 22, 24 of each full block 18 collectively form a three-sided slot having a back wall 28 which is defined by the base portion 22 and opposed sidewalls 30 which are defined by respective ones of the finger portions 24. As seen in FIG. 5, the side of the base portion 22 disposed furthest from the distal ends 26 of the finger portions 24 preferably includes an elongate tether member 32 which is attached to the approximate center thereof. The use of the tether member 32 will be described in more detail below.

In the spillway 10, each of the full blocks 18 is preferably fabricated from concrete. Additionally, the full blocks 18 are preferably pre-manufactured off-site, and are ready to use for the construction of the spillway 10 when transported to the embankment 12. As indicated above, the sizing or dimensioning of each full block 18 is, to some degree, dictated by the slope S of the embankment 12. More particularly, as further seen in FIG. 3, each full block 18 is formed to have a step height H and an overall width W which is preferably the product of a constant C and the step height H. The constant C is preferably from about 3 to 5, and most preferably about 4. The identically configured finger portions 24 of each full block 18 each have a preferred width Z, and a preferred length X which is equal to the product of the slope S and step height H. As will be recognized, the depth of the slot defined by the base and finger portions 22, 24 is equal to the lengths X of the finger portions 24, with the width of the slot being equal to the width Y of the back wall 28 defined by the base portion 22. Accordingly, the width W of each full block 18 is equal to the sum of the back wall width Y and finger portion widths Z, with the overall length L of each full block 18 (including the base and finger portions 22, 24) necessarily exceeding or being greater than the depth of the slot (i.e., the lengths X of the finger portions 24).

The half blocks 20 of the spillway 10 each comprise a base portion 34 having a finger portion 36 which extends therefrom and defines a distal end 38. The base and finger portions 34, 36 of each half block 20 collectively form a two-sided notch having a back wall 40 which is defined by the base portion 34 and a sidewall 42 which is defined by the finger portion 36. Though not shown, the side of the base portion 34 disposed furthest from the distal end 38 of the finger portion 36 preferably includes an elongate tether member identical to the previously described tether member 32 attached to the approximate center thereof.

Like the full blocks 18, each of the half blocks 20 is preferably fabricated from concrete, and pre-manufactured off-site for use in the construction of the spillway 10 when transported to the embankment 12. The sizing or dimensioning of each half block is also dictated in part by the slope S of the embankment 12. As indicated above, each half block 20 comprises one-half of a full block 18. Thus, as seen in FIG. 4, each half block 20 is formed to have the step height H and an overall width W' which is preferably one-half the width W and two times the step height H. The finger portion 36 of each half block 20 is identically configured to the finger portions 24 of each full block 18, and thus has the preferred width Z and the preferred length X which is equal to the product of the slope S and step height H. The depth of the notch defined by the base and finger portions 34, 36 is equal to the length X of the finger portion 36, with the width of the notch being equal to the width Y' of the back wall 40 defined by the base portion 34, which itself is about one-half the width Y of the back wall 28. Accordingly, the width W' of each half block 20 is equal to the sum of the back wall width Y' and finger portion width Z, with each half block 20 having the same overall length L of each full block 18 which necessarily exceeds or is greater than the depth of the notch (i.e., the length X of the finger portion 36).

Figure 6:
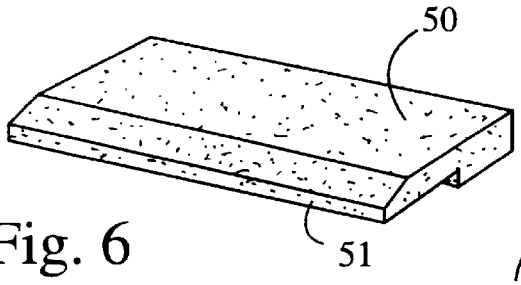
FIG. 6 is a front perspective view of a crest plate of the offset stepped spillway shown in FIG. 1.
Figure 7:
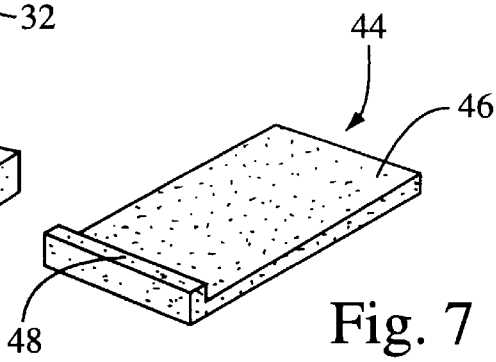
FIG. 7 is a front perspective view of a tow plate of the offset stepped spillway shown in FIG. 1.

Referring now to FIGS. 6 and 7, the spillway 10 further comprises at least one, and preferably multiple toe plates 44 (one of which is shown in FIG. 7) which extend along the toe 16 of the embankment 12 in side-by-side relation to each other. Each toe plate 44 comprises a generally rectangular base portion 46 which includes an end sill portion 48 extending upwardly from one of the lateral edges thereof. As seen in FIG. 1, the toe plates 44 are oriented within the spillway 10 such that the primary flow direction axes PF extend in generally parallel relation to the longitudinal axes of the toe plates 44.

Additionally, the lowermost row of building blocks in the spillway 10 are partially positioned upon and supported by the base portions 46 of the toe plates 44. More particularly, the finger portions 24 of the full blocks 18 comprising the lowermost row and small sections of the base portions 22 thereof are rested upon the top surfaces of respective ones of the base portions 46, with the distal ends 26 of the finger portions 24 being disposed in spaced relation to respective ones of the end sill portions 48. Since one or both of the longitudinal edges of each toe plate 44 is/are abutted against the longitudinal edge(s) of the toe plate(s) adjacent thereto, the end sill portions 48 of the toe plates 44 collectively define a continuous, upwardly extending wall. Like the full and half blocks 18, 20, the toe plates 44 are each preferably fabricated from concrete, and are pre-manufactured off-site for use in the construction of the spillway 10 when transported to the embankment 12.

The spillway 10 also includes a generally rectangular crest plate 50 which is shown in FIG. 6 and is extended along the top 14 of the embankment 12. As also seen in FIG. 1, the crest plate 50 is partially positioned upon and supported by the full and half blocks 18, 20 comprising the uppermost row of building blocks. More particularly, the crest plate 50 rests upon the base portions 22, 34 of the full and half blocks 18, 20, with the front edge 51 thereof preferably terminating rearwardly of the back walls 28, 40 defined by the base portions 22, 34. The crest plate 50 is also preferably fabricated from concrete and pre-manufactured off-site.

As further seen in FIG. 1, in the spillway 10, the full and half blocks 18, 20 are arranged such that the distal ends 26, 38 of each adjacent or abutting pair of finger portions 24, 36 in a particular row extend to the back wall 28 of the slot of a respective full block 18 in the row immediately therebelow. Additionally, the distal end 26 of each finger portion 24 in a particular row not abutting another finger portion 24, 36 extends to the back wall 40 of the notch of a respective half block 20 in the row immediately therebelow. Importantly, this particular arrangement of the full and half blocks 18, 20, in combination with the particular shapes and dimensions thereof, causes water cascading down the steps defined thereby to flow in three directions or dimensions. More particularly, water flows along the horizontally oriented primary flow direction axes PH, laterally along the horizontally oriented secondary flow direction axes SF (also shown in FIG. 1) which extend at generally right angles relative to the primary flow direction axes PH, and downwardly along the vertically oriented primary flow direction axes PV (also shown in FIG. 1) which extend at generally right angles relative to the primary and secondary flow direction axes PH, SF. Thus, water flows not only over the distal ends 26, 38 of the finger portions 24, 36, but over the sides of the finger portions 24, 36 as well, in addition to flowing over the back walls 28, 40 defined by the base portions 22, 34. This three-dimensional flow imparts velocity components to the falling water that act at generally right angles relative to the primary flow direction axes PH, PV and generate turbulence (i.e., create a churning action) which entraps air within the water and efficiently dissipates the kinetic energy thereof.

The present spillway 10 dissipates the kinetic energy of falling water at rates exceeding several magnitudes above any known prior art system. Importantly, the stacking pattern of the full and half blocks 18, 20 as described above annihilates any semblance of a stable vortex at each offset step defined thereby. The stacking pattern/offset steps also creates high gradient velocity zones, and a high lateral diffusing of velocities along the secondary flow direction axes SF. The stacking pattern/offset steps also generates slight vortex rollers, and create a shear zone where there is a negative (upslope) velocity component coming in contact with the primary positive (downslope) velocity component. As indicated above, this negative-positive contact interferes with flow along the primary flow direction axes PH, PV, thereby reducing the velocity in this direction and dissipating additional kinetic energy.

Figure 2:
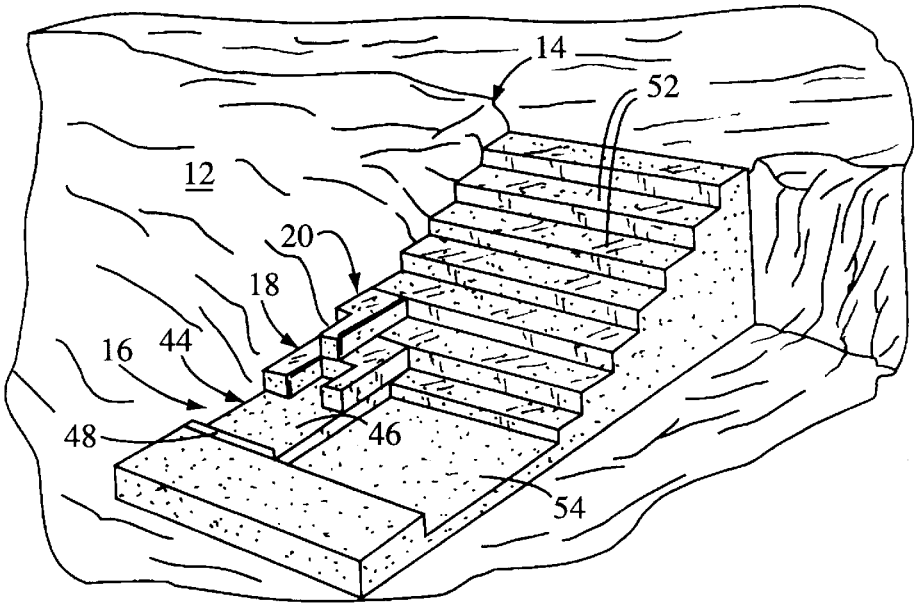
FIG. 2 is a perspective view illustrating a preferred manner of constructing the offset stepped spillway shown in FIG. 1.

Having thus described the structural and functional attributes of the spillway 10, one preferred method of constructing the same will now be discussed with specific reference to FIG. 2. The spillway 10 is preferably constructed by initially cutting a plurality of terraces 52 into the embankment 12 so as to defined a series of steps which extend from the top 14 to the toe 16 thereof. Thereafter, the toe plates 44 are positioned within a complementary trench 54 extending along the toe 16 of the embankment 12. As indicated above, the toe plates 44 are disposed within the trench 54 in side-by-side relation to each other, with the wall collectively defined by the end sill portion 48 thereof being disposed furthest from the terraces 52 cut into the embankment 12.

Subsequent to the placement of the toe plates 44, the building blocks (i.e., full and half blocks 18, 20) are arranged upon the terraces 52 in rows which are stacked upon each other in a shingle-like overlap as described above, with the lowermost row of building blocks being partially positioned upon the base portions 46 of the toe plates 44. Importantly, each of the building blocks may be anchored to the vertical wall of a respective terrace 54 through the use of its tether member (e.g., tether member 32) which extends rearwardly therefrom. Advantageously, properly arranged upon the terraces 52, the building blocks are generally maintained in their prescribed positions by the weight exerted by each row thereof against the row immediately therebelow. The anchoring of the building blocks to the terraces 52 through the use of the tether members assists in preventing any shifting or displacement thereof.

As indicated above, an additional preferred method of assembling the spillway 10 which achieves the same end result as the previously described method involves the construction of the embankment 12 from the toe 16 upwardly by backfilling against each successive row of the building blocks to create the terrace effect. This backfilling process is repeated until the desired height of the spillway 10 and the embankment 12 is obtained.

Upon the completion of the uppermost row of building blocks, the crest plate 50 is partially positioned thereupon in the above-described manner. Importantly, the weight of the crest plate 50 which acts primarily against the uppermost row of building blocks assists in maintaining the same in their prescribed positions. As indicated above, the building blocks may also be maintained in their prescribed positions through the use of the tether members 32 extending rearwardly therefrom. Additionally, the configuration of the crest plate 50 and it relationship to the upper rows of building blocks of the offset stepped spillway 10 is believed to eliminate the need for a conventional o'gee in the spillway 10 which is often required in prior art spillway designs. Because the full and half blocks 18, 20 and toe and crest plates 44, 50 are manufactured off-site to prescribed dimensions, the assembly of the spillway 10 may be accomplished in a quick and cost-effective manner. As will be recognized, the particular dimensions of the full and half blocks 18, 20 will be varied according to the slope S of the embankment 12 in which the spillway 10 is to be constructed.

Figure 9:
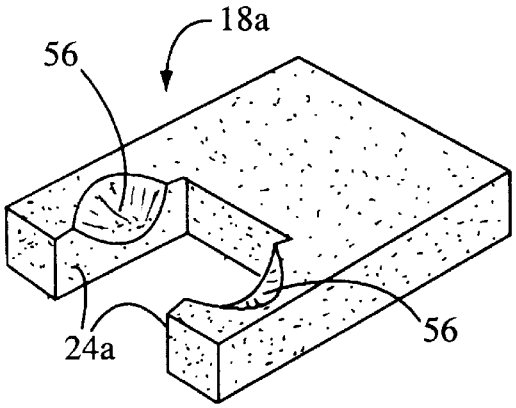
FIG. 9 is a front perspective view of a full building block of a second embodiment of the present invention used in the offset stepped spillway shown in FIG. 8.
Figure 10:
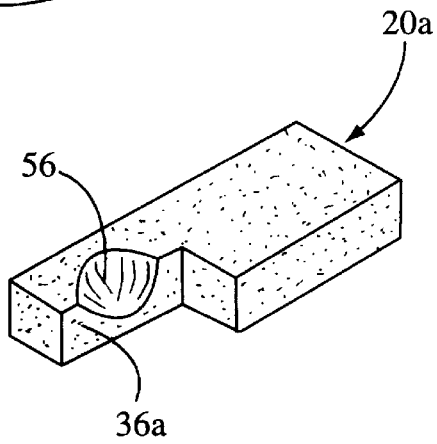
FIG. 10 is a front perspective view of a half building block of a second embodiment of the present invention used in the offset stepped spillway shown in FIG. 8.

Referring now to FIGS. 8–10, there is depicted a spillway 10*a* constructed in accordance with a second embodiment of the present invention. The spillway 10*a* is substantially identical to the previously described spillway 10, except that the finger portions 24*a*, 36*a* of the full and half blocks 18*a*, 20*a* thereof are each provided with a conically-shaped indentation 56 therein. These indentations 56 assist in directing water along the secondary flow direction axes SF as it cascades down the spillway 10*a*. Those of ordinary skill in the art will recognize that the indentations 56 may be provided in other geometric shapes.

Referring now to FIG. 11, there is depicted a full block 18*b* constructed in accordance with a third embodiment of the present invention which may be used in the assembly of the spillway 10 as an alternative to either of the previously described full blocks 18, 18*a*. The full block 18*b* comprises a base portion 22*b*. Extending from the base portion 22*b* in spaced relation to each other is an identically configured pair of finger portions 24*b*, each of which defines a distal end 26*b*. The base and finger portions 22*b*, 24*b* collectively form a generally trapezoidal, three-sided slot having a back wall 28*b* which is defined by the base portion 22*b* and opposed sidewalls 30*b* which are defined by respective ones of the finger portions 24*b*.

As with the previously described full blocks 18, 18*a*, each full block 18*b* is preferably pre-manufactured off-site, and ready to use when transported to the embankment 12. Additionally, the sizing or dimensioning of each full block 18*b* is, to some degree, dictated by the slope S of the embankment 12. More particularly, each full block 18*b* is formed to have a length L, a step height H, and an overall width W which is preferably the product of a constant C and the step height H. The constant C is preferably from about 3 to 5, and most preferably about 4. The identically configured finger portions 24*b* each have a preferred length X which is equal to the product of the slope S and step height H, with the distal ends 26*b* thereof each having a preferred width Z. The depth of the slot defined by the base and finger portions 22*b*, 24*b* is equal to the lengths X of the finger portions 24*b*, with the width Y of the back wall 28*b* partially defining the slot preferably being two times the width Z. Though not shown, the half blocks used in conjunction with the full blocks 18*b* each preferably comprise about one-half of a full block 18*b*.

Referring now to FIG. 12, there is depicted a full block 18*c* constructed in accordance with a fourth embodiment of the present invention which may be used in the assembly of the spillway 10 as an alternative to any of the previously described full blocks 18, 18*a*, 18*b*. The full block 18*c* comprises a base portion 22*c*. Extending from the base portion 22*c* in spaced relation to each other is an identically configured pair of finger portions 24*c*, each of which defines a distal end 26*c*. The base and finger portions 22*c*, 24*c* collectively form a three-sided slot having a back wall 28*c* which is defined by the base portion 22*c* and opposed sidewalls 30*c* which are defined by respective ones of the finger portions 24*c*. As seen in FIG. 12, the slot has a dovetail-like configuration.

As with the previously described full blocks 18, 18*a*, 18*b*, each full block 18*c* is preferably pre-manufactured off-site, and ready to use when transported to the embankment 12. Additionally, the sizing or dimensioning of each full block 18*c* is also, to some degree, dictated by the slope S of the embankment 12. More particularly, each full block 18*c* is formed to have a length L, a step height H, and an overall width W which is preferably the product of a constant C and the step height H. The constant C is preferably from about 3 to 5, and most preferably about 4. The identically configured finger portions 24*c* each have a preferred length X which is equal to the product of the slope S and step height H, with the distal ends 26*c* thereof each having a preferred width Z. The depth of the slot defined by the base and finger portions 22*c*, 24*c* is equal to the lengths X of the finger portions 24*c*, with the width Y of the back wall 28*c* partially defining the slot preferably being two times the width Z. Though not shown, the half blocks used in conjunction with the full blocks 18*c* each preferably comprise about one-half of a full block 18*c*.

Referring now to FIGS. 13 and 14, there is depicted a full block 18d constructed in accordance with a fifth embodiment of the present invention which may be used in the assembly of the spillway 10*d* shown in FIG. 15 as an alternative to any of the previously described full blocks 18, 18*a*, 18*b*, 18*c*. The full blocks 18*d* are substantially identical to the previously described full blocks 18*a*, and are provided with a conically-shaped indentation 56*d* within each of the finger portions 24*d* thereof. However, each of the full blocks 18*d* further includes a pair of conically-shaped indentations 58 formed in the base portion 22*d* thereof in spaced relation to each other. As seen in FIGS. 13 and 14, the indentations 58 are formed in the face of the full block 18*d* opposite that including the indentations 56*d* formed therein.

In the spillway led, the full blocks 18*d* are arranged such that the indentations 56*d* in the finger portions 24*d* of each of the full blocks 18*d* in a particular row align with one of the indentations 58 of respective ones of an adjacent pair of the full blocks 18*d* in the row immediately therebelow. As such, extending into the generally rectangular slot of each full block 18*d* in the spillway 10*d* is about one-half of two (2) separate indentations 58. The pairs of aligned indentations 56*d*, 58 and orientation of such pairs within the slot defined by each full block 18*d* increases the amount of turbulence imparted to the water as it cascades down the spillway 10*d*. The indentations 58 may also be used as a planter by filling the same with planting material to improve the aesthetics of the spillway 10*d*. Though not shown, the half blocks used in the spillway 10*d* each preferably comprise one-half of a full block 18*d*, and thus include a single indentation 58 formed therein. Like the full blocks 18*a*, the full blocks 18*d* and associated half blocks are preferably pre-manufactured off-site and ready to use when transported to the embankment 12.

Figure 16:
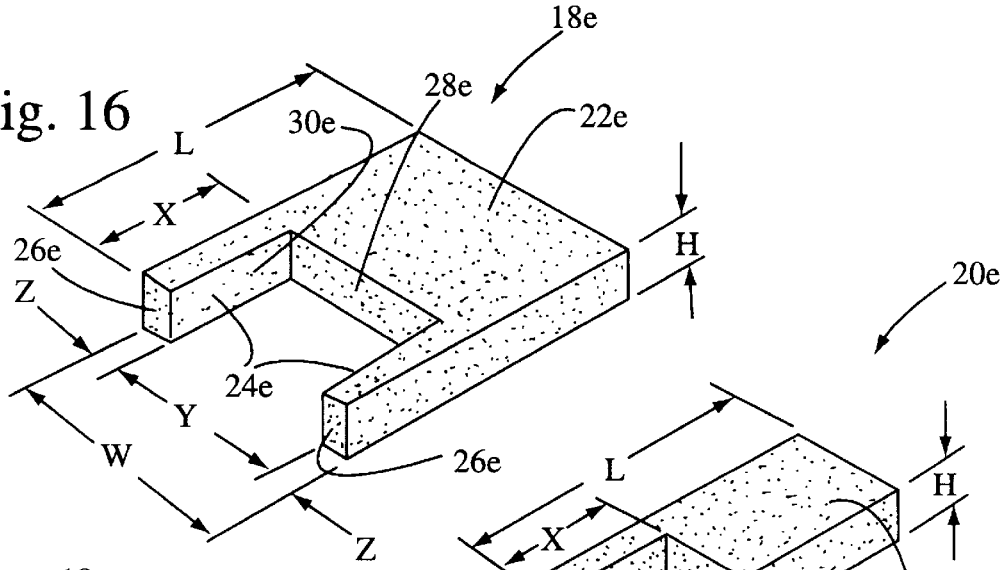
FIG. 16 is a front perspective view of a full building block of a sixth embodiment of the present invention.
Figure 17:
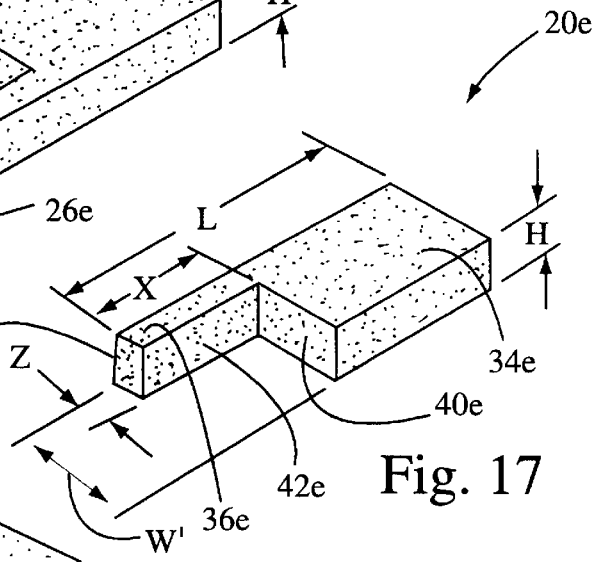
FIG. 17 is a front perspective view of a half building block of a sixth embodiment of the present invention used in conjunction with the full building block shown in FIG. 16.
Figure 18:
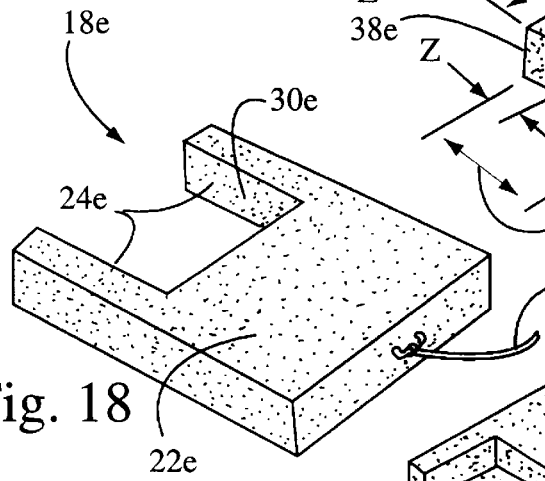
FIG. 18 is a rear perspective view of the full building block shown in FIG. 16.
Figure 19:
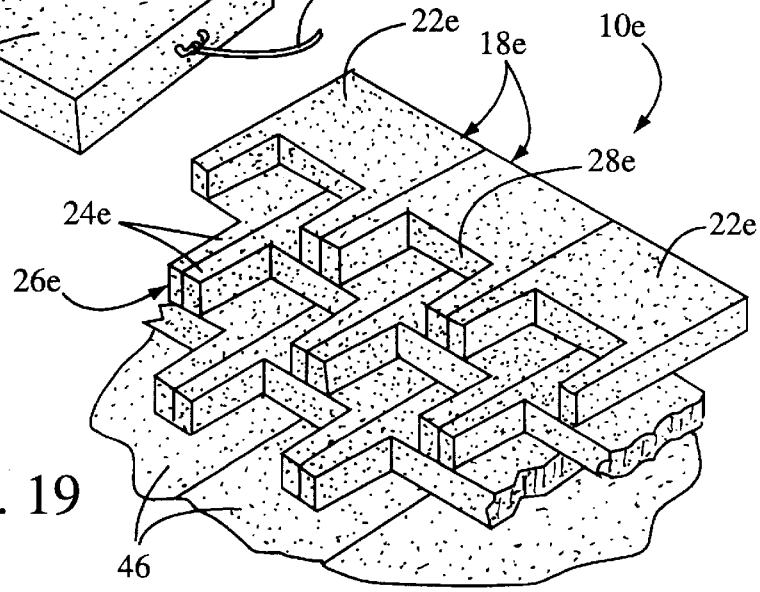
FIG. 19 is a front perspective view of a portion of an offset stepped spillway constructed using the building blocks of the sixth embodiment shown in FIGS. 16–18.

Referring now to FIGS. 16–18, there is depicted a full block 18*e* and a half block 20*e* which are each constructed in accordance with a sixth embodiment of the present invention and may be used in the assembly of the spillway 10*e* shown in FIG. 19. The full block 18*e* comprises a base portion 22*e*. Extending from the base portion 22*e* in spaced relation to each other is an identically configured pair of finger portions 24*e*, each of which defines a distal end 26*e*. The base and finger portions 22*e*, 24*e* collectively form a generally rectangular, three-sided slot having a back wall 28*e* which is defined by the base portion 22*e* and opposed sidewalls 30*e* which are defined by respective ones of the finger portions 24*e*.

Each full block 18*e* is preferably pre-manufactured off-site, and ready to use when transported to the embankment 12. Additionally, the sizing or dimensioning of each full block 18*e* is, to some degree, dictated by the slope S of the embankment 12. More particularly, each full block 18*e* is formed to have a length L, a step height H, and an overall width W which is preferably the product of a constant C and the step height H. The constant C is preferably from about 3 to 5, and most preferably about 4. The identically configured finger portions 24*e* each have a preferred length X which is equal to the product of the slope S and step height H. Additionally, the finger portions 24*e* each have a preferred width Z. The depth of the slot defined by the base and finger portions 22*e*, 24*e* is equal to the lengths X of the finger portions 24*e*, with the width Y of the backwall 28*e* partially defining the slot preferably be equal to the difference between the width W and two times the width Z. In the full block 18*e* of the sixth embodiment, the width Z of each finger portion 24*e* is about one-half the width Z of each finger portion 24 of a full block 18 constructed in accordance with the first embodiment of the present invention as shown in FIGS. 3 and 5. Attached to and extending outwardly from the approximate center of the side of the base portion 22*e* disposed furthest from the distal ends 26*e* of the finger portions 24*e* is the elongate tether member 32.

Each half block 20*e* of the sixth embodiment comprises a base portion 34*e* having a finger portion 36*e* which extends therefrom and defines a distal end 38*e*. The base and finger portions 34*e*, 36*e* collectively form a two-sided notch having a back wall 40*e* which is defined by the base portion 34*e* and a sidewall 42*e* which is defined by the finger portion 36*e*. Though not shown, the side of the base portion 34*e* disposed furthest from the distal end 38*e* of the finger portion 36*e* may include an elongate tether member identical to the previously described tether member 32 attached to the approximate center thereof.

Like the full blocks 18*e* of the sixth embodiment, each of the half blocks 20*e* is preferably fabricated from concrete, and pre-manufactured off-site for use in the construction of the spillway 10*e* when transported to the embankment 12. The sizing or dimensioning of each half block 20*e* is also dictated in part by the slope S of the embankment 12. Each half block 20*e* comprises one-half of a full block 18*e*. Thus, as seen in FIG. 17, each half block 20*e* is formed to have the step height H and an overall width W' which is preferably about one-half the width W of a full block 18*e* and equal to the product of one-half the constant C and the step height H.

The finger portion 36*e* of each half block 20*e* is identically configured to the finger portions 24*e* of each full block 18*e*, and thus has the preferred width Z and the preferred length X which is equal to the product of the slope S and step height H. The depth of the notch defined by the base and finger portions 34*e*, 36*e* is equal to the length X of the finger portion 36*e*, with the width of the notch being equal to the width Y' of the back wall 40*e* defined by the base portion 34*e*, which itself is about one-half the width Y of the back wall 28*e*. Accordingly, the width W' of each half block 20*e* is equal to the sum of the back wall width Y' and finger portion width Z, with each half block 20*e* having the same overall length L of each full block 18*e* which necessarily exceeds or is greater than the depth of the notch (i.e., the length X of the finger portion 36*e*).

As seen in FIG. 19, when the spillway 10*e* is constructed using the full and half blocks 18*e*, 20*e*, the distal ends 26*e*, 38*e* of each adjacent or abutting pair of finger portions 24*e*, 36*e* in a particular row extend to the back wall 28*e* of the slot of a respective full block 18*e* in the row immediately therebelow. However, in view of the widths Z of the finger portions 24*e*, 36*e*, the combined width of each abutting pair of finger portions 24*e*, 36*e* is less than the width Y of a respective back wall 28*e*. More particularly, the combined width of the abutting pair of finger portions 24*e*, 36*e* is about one-half the width Y. This relative sizing aids in the generation of turbulence as water cascades down the spillway 10*e*.

The dissipation of kinetic or hydraulic energy achieved by the offset stepped spillway constructed using the building blocks formed in accordance with any of the above-described embodiments of the present invention has additional applications in coastal environments, such as seawall applications for oceans or other large bodies of water. In this respect, the high efficiency of the spillway constructed in accordance with the present invention provides the ability to dissipate wave energy as water flows up the spillway, and to dissipate such energy as the wave recedes back down the spillway. As such, a spillway constructed in accordance with the present invention can be used as a replacement for conventional seawalls, and thus reduce the refractory waves and beach erosion associated with current practice.

Those of ordinary skill in the art will recognize that the building blocks constructed in accordance with any of the above-described embodiments of the present invention need not be fabricated from concrete, and may be fabricated from alternative materials, including metal. Additionally, it is contemplated that the building blocks of the present invention, whether fabricated from concrete, metal or some other material, may assume differing configurations so long as water cascading down the spillway assembled through the use of the building blocks is caused to flow in at least three dimensions in the above-described manner.

Additional modifications and improvements of the present invention may also be apparent to those of ordinary skill in the art. For example, the sidewall of the embankment along the spillway can be protected through the use of conventional concrete construction procedures, or through the use of one of many generally available pre-cast products for purposes of incorporating a non-erodible side barrier into the spillway. Additionally, the constant C may be outside the range of from about 3 to 5. For example, the constant C may be greater than 5 for the building blocks at the crest of special spillway units. Thus, the particular combination of parts described and illustrated herein is intended to represent only certain embodiments of the present invention, and is not intended to serve as limitations of alternative devices within the spirit and scope of the invention.

What is claimed is:

1. A spillway for use in a sloped embankment which defines a top and a toe, the spillway being adapted to dissipate the kinetic energy of water flowing downwardly from the top of the embankment to the toe thereof in a primary flow direction, and comprising:

a plurality of building blocks arranged in rows which are stacked upon each other in a shingle-like overlap such that the building blocks of each row are offset relative to the building blocks of each adjacent row and a series of steps are defined thereby, the building blocks comprising full blocks and half blocks with the outer most building blocks of every other row in the spillway comprising half blocks and the remaining building blocks comprising full blocks, each of the full blocks comprising:

a base portion; and a pair of finger portions which define distal ends and extend from the base portion in spaced relation to each other;

the base and finger portions of each full block collectively forming a three-sided slot having a back wall defined by the base portion and opposed side walls defined by respective ones of finger portions;

the building blocks being sized and configured such that water cascading down the steps defined thereby is caused to flow in three dimensions so as to impart velocity components to the falling water that act at generally right angles relative to the primary flow direction and generate turbulence which dissipates the kinetic energy of the water.

2. The spillway of claim 1 wherein the building blocks each include a tether extending therefrom for anchoring the building blocks to the embankment.

3. The spillway of claim 1 wherein the building blocks are each fabricated from concrete.

4. The spillway of claim 1 further comprising at least one toe plate which extends along the toe of the embankment, the lowermost row of building blocks being partially positioned upon the toe plate.

5. The spillway of claim 1 further comprising at least one crest plate which extends along the top of the embankment and is partially positioned upon the uppermost row of building blocks.

6. The spillway of claim 1 wherein the half blocks each comprise:

a base portion; and a finger portion which defines a distal end and extends from the base portion;

the base and finger portions of each half block collectively forming a two-sided notch having a back wall defined by the base portion and a sidewall defined by the finger portion;

the building blocks being arranged such that the distal ends of each abutting pair of finger portions in a particular row extend to the back wall of the slot of a respective full block in the row immediately therebelow, and the distal end of each finger portion in a particular row not abutting another finger portion extends to the back wall of the notch of a respective half block in the row immediately therebelow.

7. The spillway of claim 6 wherein the finger portions of the full and half blocks each include a generally conical indentation formed therein.

8. The spillway of claim 6 wherein:

the embankment has a slope factor S;

the full and half blocks each have a length L and a step height H;

the full blocks each have a width W;

the half blocks each have a width W';

the back wall of the slot of each of the full blocks has a width Y;

the back wall of the notch of each of the half blocks has a width Y'; and the finger portions of the full and half blocks each have a length X and a width Z;

the sizing of the full and half blocks relative to the slope of the embankment and each other being governed by the relationships:

$W=C(H)=Y+2(Z)=2(W')$, wherein C is a constant;

$Y=2(Y')$;

$W'=\frac{1}{2}(W)=\frac{1}{2}(C)(H)=Y'+Z$;

$Y'=\frac{1}{2}(Y)$;

$X=S(H)$; and $L>X$.

9. The spillway of claim 8 wherein the constant C is from 3 to 5.

10. The spillway of claim 9 wherein the constant C is 4.

11. The spillway of claim 1 wherein:

the embankment has a slope factor S;

the full blocks each have a step height H and a width W which is the product of a constant C and the step height H;

the finger portions of the full blocks each have a length X, with the distal ends thereof each having a width Z; and the back wall of the slot of each of the full blocks has a width Y which is two times the width Z.

12. The spillway of claim 11 wherein the constant C is from 3 to 5.

13. The spillway of claim 12 wherein the constant C is 4.

14. The spillway of claim 11 wherein the length X of each of the finger portions is equal to the product of the slope factor S and the step height H.

15. The spillway of claim 11 wherein the slot has a generally rectangular configuration.

16. The spillway of claim 11 wherein the slot has a generally trapezoidal configuration.

17. The spillway of claim 11 wherein the slot has a dovetail configuration.

18. The spillway of claim 1 wherein:

the embankment has a slope factor S;

the full blocks each have a step height H and a width W which is the product of a constant C and the step height H;

the finger portions of the full blocks each have a length X, with the distal ends thereof each having a width Z; and the back wall of the slot of each of the full blocks has a width Y which is equal to the difference between the width W and two times the width Z.

19. The spillway of claim 18 wherein the constant C is from 3 to 5.

20. The spillway of claim 19 wherein the constant C is 4.

21. The spillway of claim 18 wherein the length X of each of the finger portions is equal to the product of the slope factor S and the step height H.

22. The spillway of claim 1 wherein:

the base portion of each of the full blocks includes a pair of generally conical indentations formed therein; and the finger portions of the full blocks each include a generally conical indentation formed therein;

the full blocks being arranged such that the indentations in the finger portions of each of the full blocks in a particular row align with one of the indentations of respective ones of an adjacent pair of the full blocks in the row immediately therebelow.

23. A method for constructing a spillway useable in a sloped embankment defining a top and a toe and adapted to dissipate the kinetic energy of water flowing downwardly from the top of the embankment to the toe thereof in a primary flow direction, the method comprising steps of:

(a) forming a plurality of terraces within the embankment so as to define a series of terrace steps which extend from the top to the toe;

(b) extending at least one toe plate along the toe of the embankment; and (c) arranging of plurality of building blocks comprising identically configured full blocks upon the terrace steps in rows which are stacked upon each other in a shingle-like overlap such that:

(1) the full blocks of each row are offset relative to the full blocks of each adjacent row in a manner wherein the rows of the full blocks define a series of primary steps which extend in the primary direction of flow and a series of secondary steps which extend at generally right angles to the primary direction of flow such that the primary and secondary steps collectively define a three-dimensional stepped spillway system wherein water cascading down the full blocks is caused to flow in three dimensions so as to impart velocity components to the falling water that act at generally right angles relative to the primary flow direction and generate turbulence which dissipates the kinetic energy of the water; and (2) the lowermost row of full blocks is partially positioned upon the toe plate.

24. The method of claim 23 wherein the building blocks further comprise identically configured half blocks, and step (c) comprises arranging the building blocks upon the terraces such that the outermost building blocks of every other row in the spillway comprise half blocks, with the remaining building blocks comprising full blocks.

25. The method of claim 24 further comprising the step of:

(d) partially positioning a crest plate upon the uppermost row of building blocks.

26. The method of claim 24 wherein step (c) comprises anchoring each of the building blocks to the embankment.

27. A spillway for use in a sloped embankment which defines a top and a toe, the spillway being adapted to dissipate the kinetic energy of water flowing downwardly from the top of the embankment to the toe thereof in a primary flow direction, and comprising:

a plurality of building blocks comprising identically configured full blocks arranged in rows which are stacked upon each other in a shingle-like overlap such that the full blocks of each row are offset relative to the full blocks of each adjacent row and a series of steps are defined thereby;

the full blocks being sized and configured such that water cascading down the steps defined thereby is caused to flow in three dimensions so as to impart velocity components to the falling water that act at generally right angles relative to the primary flow direction and generate turbulence which dissipates the kinetic energy of the water.

28. The spillway of claim 27 wherein the building blocks further comprise identically configured half blocks, the outermost building blocks of every other row in the spillway comprising half blocks, with the remaining building blocks comprising full blocks.

29. The spillway of claim 28 wherein the full blocks each comprise:

a base portion; and a pair of finger portions which define distal ends and extend from the base portion in spaced relation to each other;

the base and finger portions of each full block collectively forming a three-sided slot having a back wall defined by the base portion and opposed sidewalls defined by respective ones of the finger portions.

30. The spillway of claim 29 wherein the half blocks each comprise:

a base portion; and a finger portion which defines a distal end and extends from the base portion;

the base and finger portions of each half block collectively forming a two-sided notch having a back wall defined by the base portion and a sidewall defined by the finger portion;

the building blocks being arranged such that the distal ends of each abutting pair of finger portions in a particular row extend to the back wall of the slot of a respective full block in the row immediately therebelow, and the distal end of each finger portion in a particular row not abutting another finger portion extends to the back wall of the notch of a respective half block in the row immediately therebelow.

* * * * *